United States Patent [19]

Sebastian et al.

[11] Patent Number: 4,638,655

[45] Date of Patent: Jan. 27, 1987

[54] HOLDING AND GUIDING A MANDREL ROD IN ROLLED STOCK IN AND ADJACENT TO A TUBE ROLLING MILL

[75] Inventors: Wilhelm Sebastian, Heiligenhaus; Wilhelm Nickel, Muelheim; Klaus-Peter Schirmag, Ratingen, all of Fed. Rep. of Germany

[73] Assignee: Mannesmann AG, Duesseldorf, Fed. Rep. of Germany

[21] Appl. No.: 676,664

[22] Filed: Nov. 30, 1984

[30] Foreign Application Priority Data

Dec. 14, 1983 [DE] Fed. Rep. of Germany ..... 3345665

[51] Int. Cl.[4] ..... B21B 25/02

[52] U.S. Cl. ..... 72/208; 72/250; 72/451; 82/39

[58] Field of Search ..... 72/208, 209, 250, 96, 72/97, 451; 82/39, 38 A, 38 R

[56] References Cited

U.S. PATENT DOCUMENTS 2,263,744 11/1941 Smith ..... 72/451 X
3,101,015 8/1963 Schuetz ..... 82/39 X
3,348,399 10/1967 Prieur ..... 72/209 X
3,722,246 3/1973 Passoni ..... 72/209 X
4,295,396 10/1981 Hasslauer ..... 82/38 A

FOREIGN PATENT DOCUMENTS 1054010 11/1983 U.S.S.R. ..... 82/39

*Primary Examiner*—Lowell A. Larson
*Assistant Examiner*—Steve Katz
*Attorney, Agent, or Firm*—Ralf H. Siegemund

[57] ABSTRACT

A mandrel rod with or without rolled tubes thereon is held by four guide structures, two arranged above and two below with respect to the axis of rolling, and each being arranged on a lever, these levers are arranged in pairs to both sides of the rolling axis, and they are particularly interconnected and connected to a common drive to permit common radial retraction of the guide structure; these guide structures have basically three different positions, one of full retraction permitting a mandrel rod with rolled tubes thereon to be removed by lifting while simultaneously a fresh mandrel rod is placed into the rolling axis from below; in a second position of the guide structures they engage a mandrel rod in the rolling axis, and in the third position they form-fittingly engage a hollow on the mandrel rod in the rolling axis.

2 Claims, 3 Drawing Figures

HOLDING AND GUIDING A MANDREL ROD IN ROLLED STOCK IN AND ADJACENT TO A TUBE ROLLING MILL

BACKGROUND OF THE INVENTION

The present invention relates to the holding of a rod in a rolling mill and for guiding rolled stock in the rolling mill for the rolling of tubes, and more particularly the invention relates to a device arranged between a rolling mill stand and the mandrel rod thrust mount, for holding such rods and being comprised of a stationary frame arranged along the rolling axis and on three sides thereof, but at a certain distance therefrom. Such a device is to have levers arranged transversely to the axis of rolling, which levers each have a guide element and are interconnected through suitable linkage for connection to a common drive for simultaneous pivoting. Moreover, such a device should include adjustable stops so as to adjust the pivot stroke of the levers in relation to different diameters as defined by the guide elements on the levers.

Devices for holding mandrel rods in rolling mills of the type referred to above are generally known, and they include, as stated, three levers with guide elements in a frame-like arrangement, Moreover, several such devices are arranged between the mandrel rod thrust mount and a mill stand proper. The respective mandrel rod is delivered to and taken from the holding device, the latter rod carrying the rolled stock for removal transversely to the direction of extension of these rods, there being a single gap between the levers and the guide elements. It thus can be seen that an exchange of mandrel rods is by necessity a sequential operation. The old one has to be removed first before a new one can take its place. This sequential operation takes a relatively long time as compared with the period of time of rolling proper. Therefore, this mode of operation for exchanging mandrel rods is not a very advantageous one from a point of view efficiency. Another disadvantage of the state of the art is to be seen in the fact that the guide elements are not very accurately adjustable in relation to the diameter of the hollow that is being rolled. The reason for this is believed to result from the hydraulic positioning under utilization of a piston cylinder arrangement of these guide elements.

The above mentioned state of the art is generally represented by the German printed patent applications Nos. 2,032,533 and 2,840,773 or U.S. Pat. No. 3,101,015.

DESCRIPTION OF THE INVENTION

It is an object of the present invention to provide a new and improved arrangement for holding mandrel rods, and particularly for facilitating and accelerating mandrel rod exchange in a tube rolling mill so that the rolling mill can be used more efficiently.

It is another object of the present invention to provide a new and improved device for holding and exchanging mandrel rods under utilization of guide elements which, when guiding and engaging the rolled stock, should engage that stock in a contour-matching fashion, because in that manner is it possible to maintain an accurate disposition.

It is another object of the present invention to improve mandrel rod in exchange in rolling mills so as to facilitate and accelerate mandrel rod exchange for increasing the effective operating time of such a rolling stand.

It is a further object of the present invention to provide a new and improved device for holding and guiding mandrel rods in rolling mills to be adjusted for contour-fitting engagement of a rolled hollow.

In accordance with the preferred embodiment of the present invention, it is suggested to provide a generally U-shaped frame extending more or less around (on three sides) a rolling axis and a delivery axis being situated, for example, below the rolling axis. Two pairs of levers are provided, respectively, on opposite sides of the rolling axis, each lever having a guide element such as a roll. The levers are interconnected in that a lever on one side pertaining to one pair and holding, for example, a guiding element more or less above the rolling axis is to be connected to a lever on the other side holding a guiding element generally situated below the rolling axis and vice versa. This arrangement permits, through suitable drive connections, radial retraction of the guide elements from the rolling axis or retention in a position where the guide elements either engage a mandrel rod in the rolling axis, or a hollow on such a mandrel rod. In the retracted-most position for the guide elements, a mandrel rod together with a hollow can be removed in vertical direction while more or less simultaneously a mandrel rod is delivered into the line of rolling from below.

The utilization of four guide elements in accordance with the invention, and mounting them in pairs, and the providing of a particular coupling among them, particularly in a cross-sectional plane transversely to the axis of rolling, permits the establishing of a single through-path during opening of the guide elements which path runs diametrically through the axis of rolling, which means that the mandrel rods are placed into the machine and removed therefrom in the same direction of movement, feed and removal path portions are no longer one and the same. This of course means that a particular mandrel rod with a hollow that has been rolled onto it can be removed while simultaneously a new mandrel rod is placed into the line of rolling.

The two pairs of levers as they are pivoted and operated by the common drive are particularly held in an intermediate position for holding and engagement of a tube on a mandrel rod, whereby specifically adjustable stop means are provided cooperating with stop means, for example, on the connecting elements between the levers. The adjustment of stop means, for example, through a suitable separate drive, permits holding of the guide elements in variable positions so as to accommodate different tubes which have been rolled of different diameters. The stop means should be arranged such that the earlier mentioned drive means operating the levers tends to retract the guide means on the levers from the rolling axis, but is prevented from doing that by the adjustable stop means. The adjustable stop means is removed when full retraction of the guide means is desired. This feature particularly facilitates the basic realization of the invention. The guide elements altogether assume three different positions. In a first position, the guide elements are open, and thereby open up the aforementioned diametrical path for obtaining mandrel rod exchange. In a second position, hydraulic drive forces the guide elements onto the mandrel rod, having been placed into the line and axis of rolling so that the rod is now held in that position. In the third position of the guide elements, they are adjusted through particular abutment surfaces for matching the contour of the hollow being rolled. These features together are instrumental in obtaining a reliable guiding of the hollow during the rolling operation, whereby particularly the guide elements are retracted against stops from the earlier position. The guide elements are therefore contour-matchingly limited as to their movement. This feature offers a considerably technical advantage over and above the heretofore positive adjustment of the guide elements during rolling of a hollow.

In furtherance of the invention it is of advantage to provide feeding and removal of mandrel rods, generally in a vertical direction, either in the up direction or in down direction, whereby particularly a U-shaped linkage is arranged to hang in down direction while the feeding and removal of mandrel rods occurs in a vertical plane.

The invention can be used in a variety of rolling mills, including mills with oblique rolls for piercing and stretching of hollows, or in a plug rolling mill.

DESCRIPTION OF THE DRAWINGS

While the specification concludes with claims particularly pointing out and distinctly claiming the subjejct matter which is regarded as the invention, it is believed that the invention, the objects and features of the invention, and further objects, features and advantages thereof will be better understood from the following description taken in connection with the accompanying drawings in which:

The figures show a device for practicing the preferred embodiment of the present invention in accordance with the best mode thereof, there being a plurality of such devices arranged between a rolling mill stand and a mandrel rod thrust mount, whereby particularly

Figure 1:
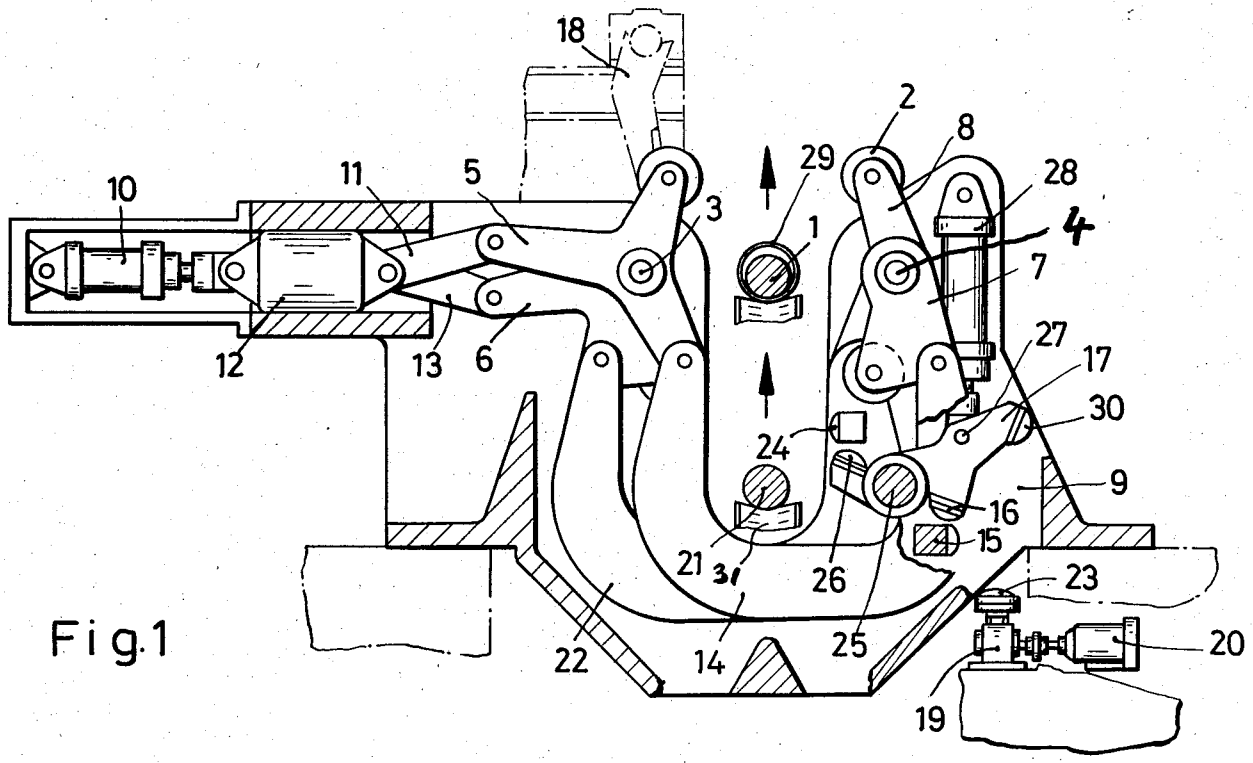
FIG. 1 illustrates the device with opened guide elements accommodating mandrel rod exchange in vertical direction.

Proceeding now to the detailed description of the drawings, the device includes a frame 9 arranged along the axis of rolling 1, which extends transversely to the plane of the drawing. This device 9 grips around axis 1 as well as around an axis for mandrel rod (21) delivery, there being a roller track 31 accordingly. The frame is shown in FIG. 1 to be open towards the upper direction. The frame is provided for mounting and journalling levers 5, 6, 7 and 8, whereby levers 5 and 6 from a pair arranged on axis 3, and levers 7 and 8 constitute a second pair mounted on axis 4. These axes 3 and 4 are arranged on opposite sides in relation to the rolling axis 1.

The levers carry guide elements such as rolls 2. The levers 5 and 6 on the left side in the figures are connected to a drive 10 through coupling rods 11 and 13, which in turn are connected to a slide or carriage 12 running in a particular guide. The carrier 12 is connected directly to the drive 10. The drive 10 causes the carriage 12 in the figures to move, for example, to the right so that the carriage 12 will cause the left hand guide elements 2 to move towards axis 1 while a retraction or pulling of the carriage 12 by the drive 10 causes these guide elements to open and retract from the rolling axis. In the first case, these guide elements will engage the mandrel rod situated in the rolling axis, while in the latter case the guide elements are removed from the mandrel rod.

The right hand pair of guide elements on the two levers 7 and 8 is connected to the left hand guide element structure through U-shaped connecting elements 14 and 22, whereby respectively the U-shaped connecting element 14 interconnects levers 5 and 7, while connecting element 22 connects lever 6 to lever 8. The connections are made such that the two levers 5 and 8 which support guide rolls for the mandrel rod from above are not interconnected directly in that manner, rather a guide roll supporting the mandrel rod from above on one side is connected to the lever on the other side, whose guide roll supports the mandrel rod from below. The U-shaped connecting elements 14 and 22 loop partially around the rolling axis, as well as a mandrel feed device 31.

Figure 2:
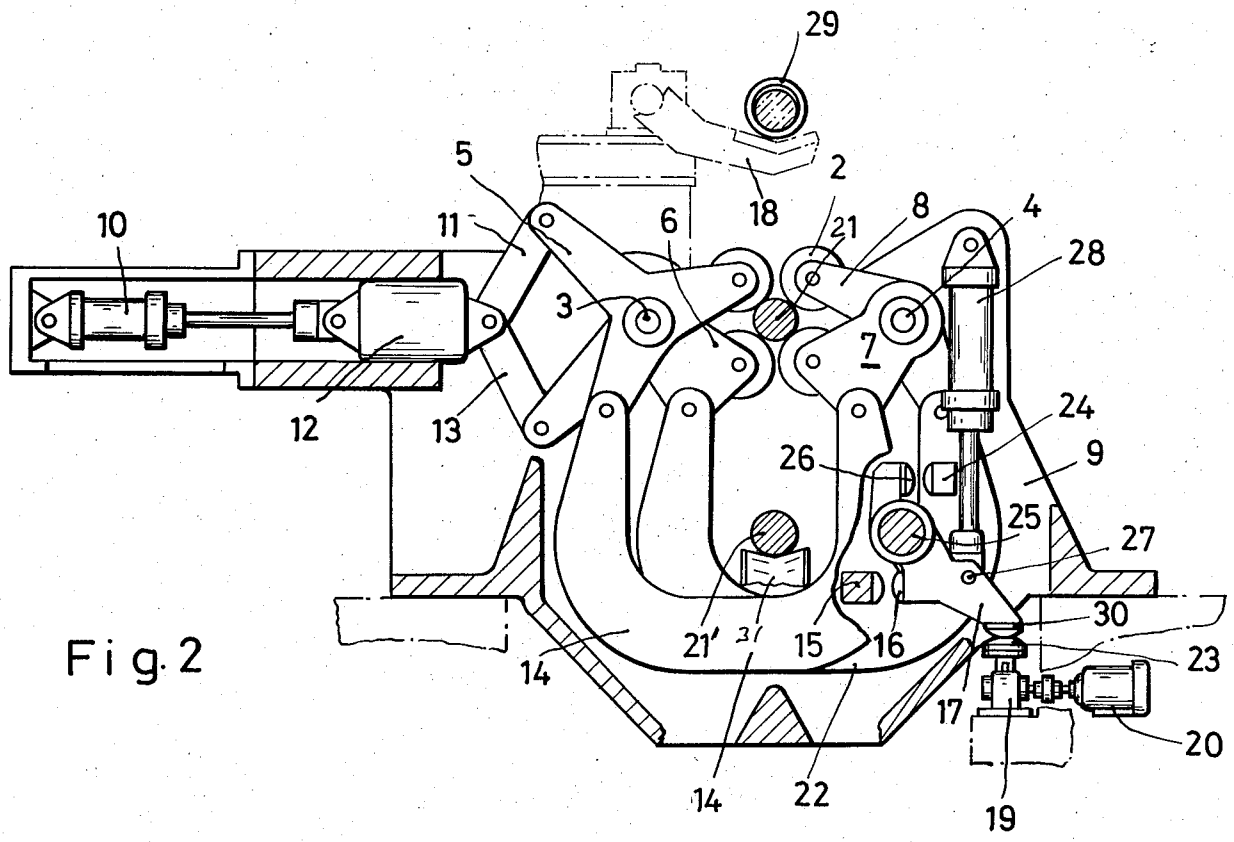
FIG. 2 illustrates the same device in a second position for holding a mandrel rod in the axis and line of rolling.

As is further shown in the drawing, a stop 23 is provided, which is adjusted by means of a drive 19 and 20. The adjustment of the stop 23 causes the four guide rolls to be accommodated to different diameters of whatever they are engaged with. As shown in FIGS. 1 and 2, a counter stop 30 cooperates with the adjustable stop 23. In the open position of guide elements as per FIG. 1, this cooperation is not present. Contrary to the state of the art, the counter stop 30 is not directly connected with the elements 5, 6, 7, 8, 14 and 22, but indirectly. This indirect connection establishes an advantageous form-fitting limit on movements on the guide elements upon opening to the diameter of the hollow.

The counter stop 30 is arranged on a lever 17, which is pivotably linked to the frame 9, pivoting to occur around axis 25. Lever 17 moveover carries counter stops 26 and 16 being provided on suitable locations, and cooperating with stops 15 and 24 mounted respectively on the U-shaped connecting elements 14 and 22. The figures are to be understood in that the stop 15 is arranged on the connecting element 14, and the stop 24 is arranged on the connecting element 22. Therefore, lever 17 is situated when seen in direction of the rolling axis 1, between the two U-shaped connecting elements 14 and 22.

Figure 3:
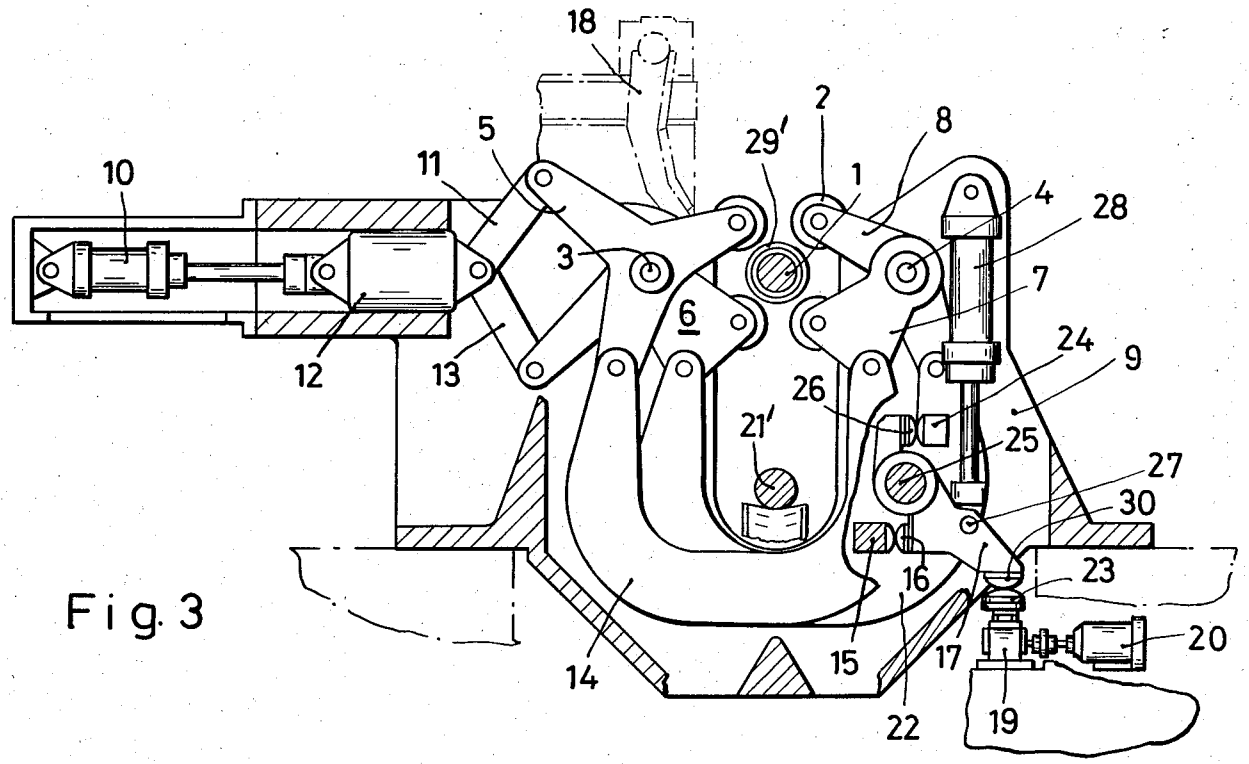
FIG. 3 illustrates a position of the hollow guidance in accordance with the third position of the same device for engaging a tube that has just been rolled onto a mandrel rod.

A piston cyclinder combination 28 engages lever 17 at a point of linkage 27. This drive 28 in turn is linked to the frame 9. The drive 28 permits lever 17 to be positioned in one of two positions; the one position is shown in FIG. 1, and the other position is shown in FIGS. 2 and 3, whereby the position of the lever 17 in the last mentioned two figures is characterized by cooperation of stops and counter stops including 23 and 30.

The device as described thus far operates as follows. Beginning with FIG. 1, the figure illustrates a situation in which a hollow 29 has just been rolled. Therefore, a "used" mandrel rod is situated in the axis of rolling and carries the rolled hollow 29. The drive 28 has retracted the counter stops 30, 27 and 26, whereby in particular the counter stop 30 does not engage stop 23. Moreover, the drive 10 for all of the levers 5 through 8 with the guide elements such as rolls 2 has been retracted in the figure to the left. Therefore, the guide elements as such are in the open position in which they are the farthest from rolling axis 1. This then permits removal of the mandrel rod 1 with hollow 29, for example, in the vertical and upward direction. The removal structure is not shown but is conventional, but what is shown is a transporting lever 18 in relation to which the mandrel 1 with hollow 29 will be placed for further removal of mandrel rod and hollow from the rolling stand.

Concurrently thereto a new mandrel rod 21 is lifted from the mandrel rod delivery track 31 and moved in to the rolling axis 1. This next operating position is shown in FIG. 2, showing particularly mandrel rod 1 and hollow 29 in engagement with the transport lever 18, and showing furthermore the particular mandrel rod 21 in alignment with the axis of rolling, while a third, fresh mandrel rod 21' is or is about to arrive in the mandrel rod delivery path.

As soon as mandrel rod 21 has been placed into the axis 1, the guide elements 2 close in that the drive 10 moves the carriage 12 towards the right. This then causes the levers to pivot so that the guide rolls 2 indeed engage the mandrel rod 21; rolling can begin. By comparing FIG. 1 and FIG. 2 one can readily see that the fresh mandrel rod 21 can be placed in position and the guide elements can be caused to close on that mandrel rod 21 as soon as the hollow 29 with its carrying mandrel rod is removed from the axis of rolling. Simultaneously, the pivot lever 17 is pivoted by the drive 28 so that the counter stop 30 engages the adjustable stop 23. At first the stop counter stop pairs 24, 26 and 15, 16 do not abut. This is particularly illustrated in FIG. 2.

Now, as soon as a new tube or pipe being rolled has been shifted onto the mandrel rod 21 so that the cross section of that tube or hollow 29' (FIG. 3) is about to enter the cross-sectional plane illustrated in the drawings, it must be expected that the hollow is to be engaged by the guide rolls. In FIG. 2, the guide rolls engage the mandrel rod 21 directly, but now it is to be expected that the one end of the hollow being rolled anew, such as 29', will reach equipment illustrated. Now the drive 10 will pull the carriage 12 somewhat to the left, but not as far as shown in FIG. 1. Stop and counter stop pairs 24, 26 and 15, 16 will abut. This means that the guide elements 2, through the pivoting of the levers 5, 6, 7 and 8, are somewhat removed from the mandrel rod 1 just sufficient that the tube being rolled, 29', can pass through. This operational state is shown in FIG. 3.

As soon as the tube or hollow 29' has been completed in this particular rolling path and stand, the mandrel rod 21 with the hollow will be longitudinally retracted to some extent so as to clear the roll stand, and the mandrel rod 21 with hollow 29' can be removed laterally, i.e., vertically, from the rolling axis. This will require that the drive 28 operates so that all stops 15 and 24 are free and the guide elements 2 are open to the position shown in FIG. 1, whereupon of course the cycle will be repeated.

The invention is not limited to the embodiments described above, but all changes and modifications thereof not constituting departures from the spirit and scope of the invention are intended to be included.

We claim:

1. Device for holding a mandrel rod adjacent to a mill for rolling and for guiding the rolled stock, there being a rolling axis and a delivery path for fresh mandrel rods being arranged in vertical alignment, comprising:

a basically U-shaped frame structure arranged on three sides of the rolling axis as well as of the mandrel rod delivery path, said frame structure being open on the fourth side to permit removal of a mandrel rod with rolled hollow thereon in the direction opposite the disposition of the mandrel rod delivery axis;

a first pair of levers arranged and mounted on the frame structure to one side of the rolling axis and respectively having guide elements, one of the guide elements being disposed above the rolling axis the other guide element being disposed below the rolling axis;

a second pair of levers arranged and mounted on the frame structure to another side of the rolling axis each likewise having a guide element, one of guide elements of the second pair of levers being disposed above the rolling axis and the other one of the guide elements of the second pair of levers being disposed below the rolling axis;

a pair of U-shaped connecting elements interconnecting levers pertaining to different ones of said pairs such that a lever of one of the pairs having a guide element disposed above the rolling axis is connected to a lever of the other pair having a guide element disposed below the rolling axis; and a common drive means connected to one of the pairs for moving all said levers in unison in between different positions in which the respective guide elements have different radial distances from said axis of rolling.

2. Device as in claim 1 and including adjustable stop means for engagement with and disengagement from stops on said connecting means for establishing at least one of said particular positions of said guide means so that said guide means is adjustable for engagement with tubes of different diameter, said drive means tending to increase the distance of the guide elements from the roll axis, said adjustable stop means when engaging said stops on said connecting means preventing further increase of said distance.

* * * * *